United States Patent [19]

Morita et al.

[11] 3,984,977

[45] Oct. 12, 1976

[54] EXHAUST PORT ARRANGEMENT IN COMBUSTION ENGINE

[75] Inventors: Yasuyuki Morita; Takuso Yamaguchi, both of Hiroshima, Japan

[73] Assignee: Toyo Kogyo Co., Ltd., Japan

[22] Filed: Aug. 25, 1975

[21] Appl. No.: 607,822

[30] Foreign Application Priority Data

Oct. 9, 1974 Japan ..... 49-122053[U]

[52] U.S. Cl. ..... 60/282; 60/272

[51] Int. Cl.[2] ..... F01N 3/10

[58] Field of Search ..... 60/272, 282, 304, 305

[56] References Cited

UNITED STATES PATENTS

| | | | |
|---|---|---|---|
| 2,260,656 | 10/1941 | Bell | 60/272 |
| 2,295,436 | 9/1942 | Tendler | 60/305 |
| 3,590,579 | 7/1971 | Takahashi | 60/305 |

FOREIGN PATENTS OR APPLICATIONS

| | | | |
|---|---|---|---|
| 1,476,589 | 3/1970 | Germany | 60/282 |

*Primary Examiner*—Douglas Hart

*Attorney, Agent, or Firm*—Wenderoth, Lind & Ponack

[57] ABSTRACT

An automobile combustion engine having at least one exhaust port is provided with a tubular insert within an engine casing. This tubular insert is accommodated within an exhaust passage leading from at least one combustion chamber towards the exhaust port, and is held in position by the interposition of a heat insulating member made of heat insulating material having a lower thermal conductivity than that of material of the engine casing and/or the tubular insert. Heat transfer from the tubular insert to the engine casing is minimized by the interposition of the heat insulating member thereby avoiding a possible reduction of the temperature of an exhaust gas flowing through the tubular insert towards a subsequent process station.

5 Claims, 8 Drawing Figures

EXHAUST PORT ARRANGEMENT IN COMBUSTION ENGINE

BACKGROUND OF THE INVENTION

The present invention generally relates to a connection between an exhaust tubing and an exhaust port in the combustion engine casing and, more particularly, to a mounting of a tubular insert within the exhaust port to minimize or substantially eliminate a possible loss of heat of an exhaust gas flowing therethrough.

Specifically, the present invention pertains to an improvement in a combustion engine casing having at least one exhaust port in communication with combustion chamber within the engine casing, said exhaust port having a substantially tubular insert held in position within the exhaust port through a heat insulating member for minimizing or substantially eliminating any possible reduction in temperature of an exhaust gas to be exhausted through the exhaust manifold or tubing to the outside of the combustion chamber by way of said exhaust port.

In some of conventional combustion engines used, for example, in automotive vehicles, an exhaust gas purifying device, for example, a thermal reactor for reburning unburned components of the exhaust gas to substantially purify the latter, is installed in the exhaust system of the engine. Because of the nature and construction of the thermal reactor known to those skilled in the art, reduction of the temperature of the exhaust gas prior to said exhaust gas entering the thermal reactor does not ensure an efficient and effective re-combustion of the unburned exhaust gas components within the thermal reactor.

In order to avoid this, various methods have heretofore been employed and one of them is the use of a tubular insert installed within an exhaust passage leading from the combustion chamber to the exhaust port. The tubular insert extends from the plane of the exhaust port into the exhaust passage with its outer peripheral surface held in spaced relation to the surrounding wall, which has been left to define the exhaust passage, thereby minimizing or substantially eliminating any reduction of the temperature of the exhaust gas which may otherwise be effected by the influence of the temperature of the engine casing which is liquid-or air-cooled.

Structurally, the tubular insert heretofore used for the purpose described above has one end integrally formed with a radially outwardly extending annular flange through which said tubular insert is pressure-fitted into the exhaust port. This will now be described with particular reference to FIG. 1.

In FIG. 1, the engine casing is partially illustrated in section by 10. The combustion chamber 11 is in communication with the exhaust port, generally indicated by 12, through the exhaust passage 13 formed in the engine casing 10. As is well known to those skilled in the art, the combustion chamber 11 is selectively communicated and incommunicated with the exhaust passage 13 in a known manner by, for example, a poppet valve 14.

One of the opposed ends of the exhaust passage 13 which is remote from the combustion chamber 11 is radially outwardly enlarged in diameter to provide at least one support bore 13*a* into which the annular flange 15*a* of the tubular insert 15 is pressure-fitted with the body of said insert 15 extending into the exhaust passage 13 in spaced relation to the surrounding wall defining the exhaust passage 13.

In the conventional support structure for the tubular insert 15, the contact area between the engine casing 14 and the insert 15 is relatively so large that heat evolved in the tubular insert 15 in contact with the exhaust gas flowing therethrough tends to be transferred to the engine casing 10 through the flange 15*a* and then the support bore 13*a*. Consequently, a loss of heat occurs in the tubular insert 15 and the latter is somewhat cooled to a reduced temperature in substantial proportion to the amount of heat energies lost. As hereinbefore described, reduction in temperature of the tubular insert accompanies corresponding reduction in temperature of the exhaust gas flowing through the tubular insert 15. This is turn leads to reduction of the combustibility of the unburned components of the exhaust gas which are to be subsequently reburned in the thermal reactor.

SUMMARY OF THE INVENTION

Accordingly, an essential object of the present invention is to provide an improved support structure for the tubular insert, wherein a heat insulating member is interposed between the engine casing and the tubular insert to minimize, or substantially eliminate, the reduction of the temperature of the tubular insert and, therefore, that of the exhaust gas, thereby substantially eliminating the disadvantage referred to above and inherent in the conventional support structure of a similar kind.

Another important object of the present invention is to provide an improved support structure of the type referred to above, wherein heat transfer from the tubular insert to the engine casing is so minimized that a good combusibility of the unburned components of the exhaust gas can advantageously be maintained to ultimately ensure substantial purification of the exhaust gas prior to the latter being discharged to the atmosphere.

A further object of the present invention is to provide an improved support structure of the type referred to above, wherein the contact area between the heat insulating member and the tubular insert and/or between the heat insulating member and the engine casing is, for the purpose of improving a heat insulating relation between the tubular insert and the engine casing, minimized to such an extent that any undesirable problem as to durability will not substantially arise even through the support structure is subjected to severe vibrations inherent in the combination engine being operated.

A still further object of the present invention is to provide an improved support structure of the type referred to above, wherein the heat insulating member is so simple in structure that installation thereof in position within the exhaust port of the engine casing can be carried out readily with no substantial skill being required and without incurring any unreasonable increase of the manufacturing cost of the combustion engine.

In accomplishing these objects of the present invention, there is provided a heat insulating member in the form of a ring. The heat insulating ring is made of ceramic or metallic material having a lower thermal conductivity than that of material for one or both of the engine casing and the tubular insert. Although the use of the material of lower thermal conductivity for the heat insulating ring is preferred irrespective of the method of mounting of the heat insulating ring in relation to both of the engine casing and the tubular insert, any material if it has a physical strength sufficient to withstand the severe vibrations and the elevated temperature may be employed for the heat insulating ring. This is because a satisfactory heat insulated relation between the tubular insert and the engine casing can also be achieved even if the heat insulating ring is designed such as to minimize the contact area between the heat insulating ring and the engine casing and/or between the heat insulating ring and the tubular insert.

In any event, in consideration of support the engine casing does in relation to the tubular insert through the heat insulating ring, stainless steel is preferred as a material for the heat insulating ring in terms of thermal conductivity and physical strength.

Because of the interposition of the heat insulating member or ring according to the present invention, no substantial reduction in temperature of the tubular insert and, therefore, that of the extent gas flowing through the tubular insert in the exhaust passage in the engine casing take place. Since the exhaust gas flowing through the tubular insert supported according to the teachings of the present invention can advantageously maintained at an elevated temperature as compared with that flowing through the tubular insert supported in the conventional manner, chemical change of the unburned components of the exhaust gas by way of combustion in the case of the purifying device being a thermal reactor, or by way of chemical reaction in the case of the purifying device being a catalytic converter, can effectively and economically be facilitated. The result is a reduction of the amount of the noxious unburned components, such as CO and HC, which are contained in the exhaust gas emerging from the engine combustion chamber. This is turn leads to reduction of the amount of fuel consumed by the combustion engine, the reason for which will now be described.

The thermal reactor currently used is such that satisfactory combustion of the unburned components of the exhaust gas, if the temperature of the latter is sufficiently high, takes place with a relatively small amount of the unburned components introduced thereinto, but will require a relatively large amount of the unburned components if the temperature of the exhaust gas is relatively low. Because of and in consideration of this operational characteristic of the thermal reactor, in order to avoid a possible failure to reburn the unburned components of the exhaust gas within the thermal reactor due to the reduced temperature of the exhaust gas, a relatively enriched air-fuel mixture has heretofore been supplied into the engine combustion chamber. This has been considered one of the major causes of the high consumption of fuel in an automotive vehicle whose engine exhaust system includes such a thermal reactor. Since combustion of the unburned components of the exhaust gas within the thermal reactor may be said to be initiated by a process of 'self-ignition' relying, not solely, but mostly, on the elevated temperature of the exhaust gas, reduction in temperature of the exhaust gas adversely affects on the amount of fuel consumed by the combustion engine.

Consequently, substantial prevention of heat energies, evolved in the exhaust gas, from being transferred to the engine casing through the tubular insert, which is satisfactory and effectively achieved in the present invention, is advantageous in that the amount of fuel to be consumed by the combustion engine can substantially be reduced as hereinbefore described.

In addition to the foregoing advantages of the present invention, the interposition of the heat insulating member or ring is further advantageous in that it substantially avoids a heating of a portion of the engine casing around and adjacent the exhaust port, thereby substantially eliminating a possibility of occurrence of physical fatigue which may otherwise occur at that portion under the influence of the elevated temperture.

BRIEF DESCRIPTION OF THE DRAWING

These and other objects and features of the present invention will become apparent from the following description made in conjunction with preferred embodiments thereof with reference to the accompanying drawings, in which.

DESCRIPTION OF PREFERRED EMBODIMENT

Figure 1:
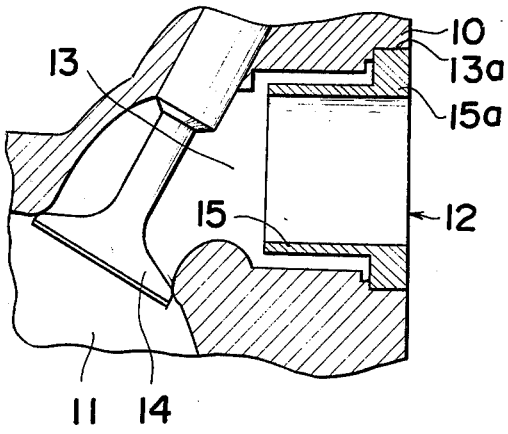
FIG. 1 Prior Art
FIG. 1 is a sectional view of a portion of a combustion engine, showing the conventional mounting of the tubular insert within the exhaust port.

Before the description of the present invention proceeds, it should be noted that like parts are designated by like reference numerals throughout the accompanying drawings.

Figure 2:
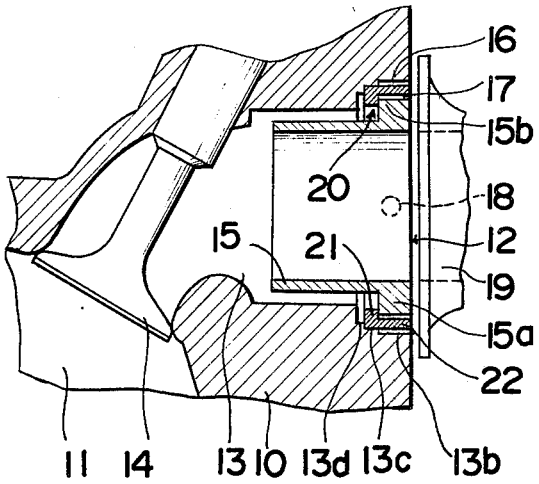
FIG. 2 is a view similar to FIG. 1, showing a first preferred embodiment of the present invention.
Figure 3:
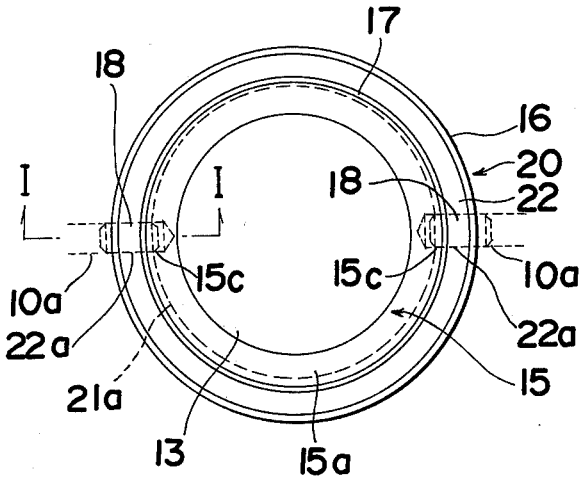
FIG. 3 is a front elevational view of a heat insulating ring employed in a support structure for the tubular insert according to the first preferred embodiment of the present invention.
Figure 4:
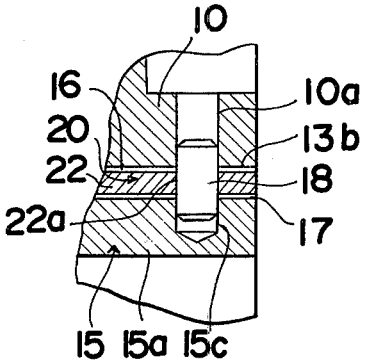
FIG. 4 is a cross sectional view taken along the line I—I in FIG. 3, showing a manner of insertion of one of fixture pins for holding the heat insulating ring of FIG. 3 in a predetermined position within the exhaust port.

Referring first to FIGS. 2 to 4, the exhaust passage 13 within the engine casing 10 has an outer end portion radially outwardly indented in three stages to provide first, second and third bores 13*b*, 13*c* and 13*d*, the diameter of each of which is greater than that of the remaining portion of the exhaust passage 13 and stepwisely decreases in the order from the first bore 13*b* to the third bore 13*d*.

The tubular insert to be employed in the present invention may be identical with that shown in FIG. 1. However, since the tubular insert 15 is, according to the teachings of the present inention, invention, in position within the exhaust passage 13 without the radially outwardly extending flange 15*a* being directly pressure-fitted into any of the bore 13*b* to 13*d* as will be described in more detail, the outer diameter of the flange 15*a* of the tubular insert 15 may be smaller than that required in the prior art arrangement of FIG. 1.

The heat insulating member used in the embodiment of FIGS. 2 to 4 comprises a support ring, generally indicated by 20, which ring 20 includes a ring body 21 having one annular face integrally formed with an axially extending flange 22. The inner diameter of the ring body 21, that is, the diameter of a bore 21*a* of the ring body 21, is smaller than the inner diameter of the axially extending flange 22, but the outer diameter of the ring body 21 is equal to the outer diameter of the axially extending flange 22. This support ring 20 is held in position within the exhaust passage 13 in such a manner that the ring body 21, having an outer diameter substantially equal to or slightly greater than the diameter substantially equal to or slightly greater than the diameter of the second bore 13*c*, is pressure-fitted into the second bore 13*c* with a radially outer portion of the other annular face thereof abutting against an annular land, defined by the difference in diameter between the second and third bores 13*c* and 13*d*, while the axially extending flange 22 is oriented towards the opening of the exhaust port 12 and terminates in flush with the plane of said opening of said exhaust port 12.

In the arrangement so far described, an adiabatic space is defined at 16 between the wall of the bore 13*b* and the outer peripheral surface of the axially extending flange 22 of the support ring 20.

While the support ring 20 is held in position within the exhaust passage 13 in the manner as hereinbefore described, the tubular insert 15 is held in position within the exhaust passage 13 in a manner which will now be described.

As shown in FIG. 2, the outer diameter of the flange 15*a* of the tubular insert 15 with which the heat insulating ring 20 of FIG. 3 is associated is smaller than the inner diameter of the flange 22, but greater than the diameter of the bore 21*a* of the ring body 21. The tubular insert 15 extends through the heat insulating ring 20 into the exhaust passage 13 and is held in position with a radially outer portion 15*b* of an annular face of said flange 15*a* abuting against the ring body 21, said portion 15*b* of said annular face of said flange 15*a* being defined by the difference in outer diameter between the body of the tubular insert 15 and the flange 15*a* of said insert 15. Consequently, it will be clear that a second adiabatic space is formed at 17 between the inner peripheral surface of the axially extending flange 22 of the heat insulating ring 20 and the outer peripheral surface of the radially outwardly extending flange 15*a* of the tubular insert 15.

In order to avoid a possible relative rotation of one or both of the heat insulating ring 20 and the tubular insert 15 with respect to the engine casing 10, the heat insulating ring 20 and tubular insert 15 are connected to the engine casing 10 by means of at least two mounting pins 18 in such a manner as will now be described withh particular reference to FIG. 4. It is to be noted that, because both of the mounting pins 18 are mounted in the same manner, reference will be made to only one of these pins 18 for the sake of brevity, it being understood that the position of these pins 18 is spaced 180° with respect to each other about the center of the contour of the exhaust port 12.

Referring now to FIG. 4, for accommodating the mounting pin 18 mounted in the manner as will be described later, the heat insulating ring 20 has a bearing hole for each pin 18, which bearing hole is formed at 22*a* in the flange 22 of the ring 20 and extends completely through the thickness of said flange 22. On the other hand, the tubular insert 15 has a bearing recess 15*c* for each pin 18, which recess 15*c* is formed in the flange 15*a* of the insert 15 and terminates substantially intermediately of the thickness of the flange 15*a* of the tubular insert 15. These bearing hole 22*a* and recess 15*c* for each mounting pin 18 may be formed either before or after the heat insulating ring 20 and the tubular insert 15 have been held in position within the exhaust passage 13 in the manner as hereinbefore described.

As shown in FIGS. 3 and 4, the mounting pin 18 is inserted from the outside of the engine casing 10 through a bearing hole 10*a*, formed in the engine casing 10 for each pin 18, and extends into the bearing recess 15*c* across the adiabatic space 16, then the bearing hole 22*a* and finally the adiabatic space 17. For avoiding a possible separation of the pin 18 out of the bearing hole 10*a*, a portion of the bearing hole 10*a* adjacent one of the opposed openings which faces the outside of the engine casing 10 may be closed with the use of a filler material. Alternatively, a thread engagement may be possible in which case the bearing bore 10*a* should be threaded on one hand and, on the other hand, one of the opposed end portions of the pin 18 which is held within the bearing bore 10*a* when the pin 18 which is held within the bearing bore 10*a* when the pin 18 has completely been inserted should be threaded in complementary relation to the threads on the bearing bore 10*a*.

Figure 5:
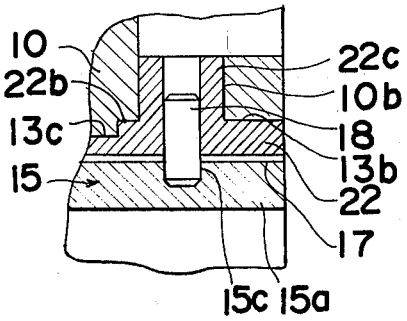
FIG. 5 is a view similar to FIG. 4, showing a modified manner of insertion of the same.

Preferably, each of the pins 18 has a flexibility or deformability sufficient to allow one or both of the heat insulating ring 20 and the tubular insert 15 to displace in any direction parallel to the longitudinal axis of the tubular insert 15 and/or of circumference of any of said ring 20 and insert 15 by the effect of one or both of heat expansion and vibration. Therefore, the use of spring pins is preferred for these pins 18.

Where each of the mounting pins 18 is desired to be inserted in such a manner as shown in FIG. 5, a modification is required in the configuration of the heat insulating ring 20. Specifically, the heat insulating ring used in the arrangement of FIG. 5 is such that the flange 22 therefore has an outer peripheral surface partially formed with a radially outwardly protruding land 22*b* of a size sufficient to fill up the adiabatic space 16 which has been described as formed in the arrangement of FIG. 2 and which is not necessary in the arrangement of FIG. 5.

Radially outwardly extending from the land 22*b* on the flange 22 of the heat insulating ring 20 are bearing sleeves 22*c*, only one of which is shown in FIG. 5, which are received in position within corresponding bearing bores 10*b* formed in the engine casing 10 in a substantially similar manner as the bearing holes 10*a* in the foregoing arrangement of FIG. 4. Each of the pins 18, that is, spring pins, extends through the hollow of the corresponding sleeve 22*c*, integrally formed with the flange 22, and terminates within the bearing recess 15*c* across the adiabatic space 17.

In the arrangement of FIG. 5, since the pins 18 are isolated from the engine casing 10 by the interposition of the sleeves 22*c*which support said pins 18 therein, the temperature of the tubular insert 15 is substantially prevented from being transferred to the engine casing 10.

After the heat insulating ring 20 and the tubular insert 15 have been placed in position within the exhaust passage 13 in the manner as hereinbefore described, an exhaust manifold or tubing 19 is flanged to the engine casing 10 in a known manner with the opening of the insert 15 aligned with the opening of said tubing 19, substantially as shown in FIG. 2.

In the embodiment shown in FIGS. 2 to 4, the radially outer portion 15*b* of one annular face of the flange 15*a* of the tubular insert 15 has been described as held in contact with the ring body 21 of the heat insulating ring 20 over the entire area thereof. To minimize the contact area between the portion 15*b* and said ring body 21 is possible if one of said portion 15*b* and said ring body 21 to which said portion 15*b* is engaged is ribbed, or otherwise formed with three or more projections through which the other of said portion 15*b* and said ring body 21 contacts said one of said portion 15*b* and said ring body 21.

Figure 6:
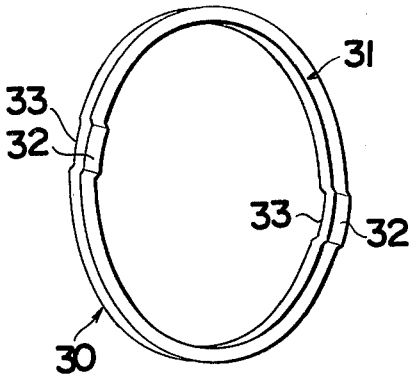
FIG. 6 is a perspective view of a modified form of heat insulating ring.
Figure 7:
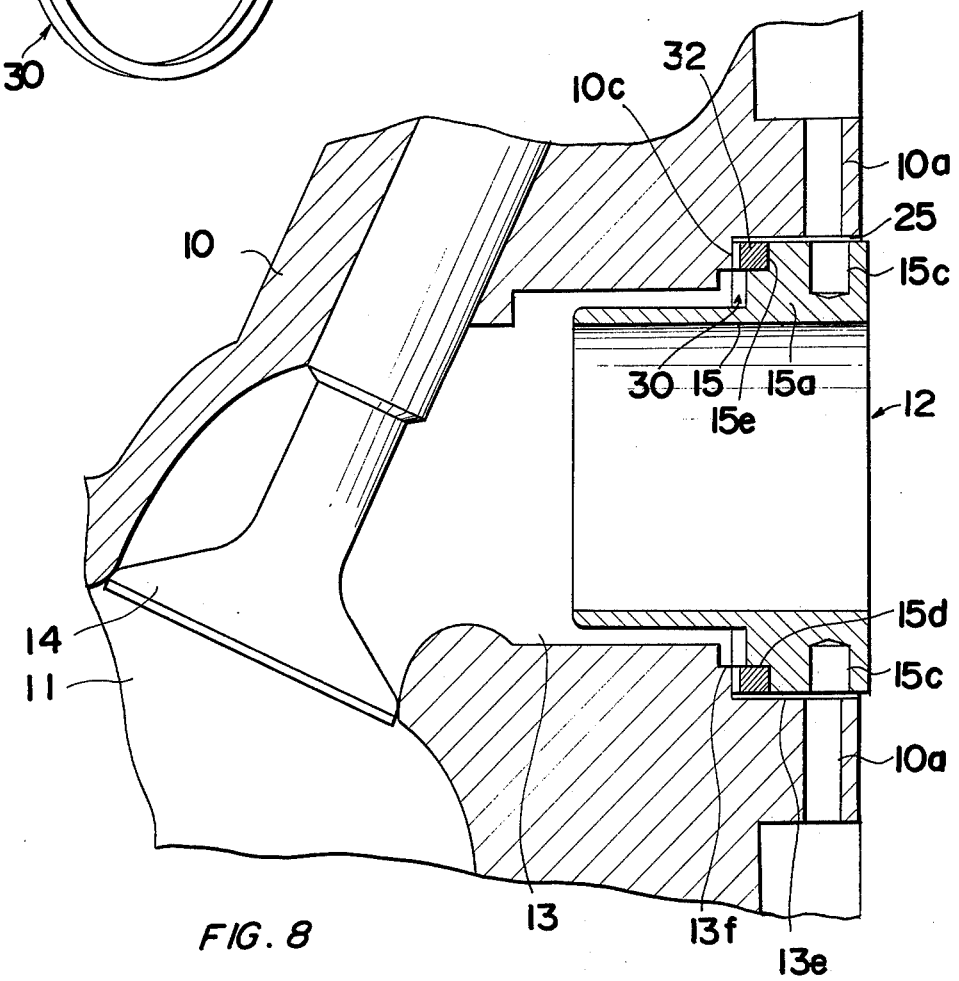
FIG. 7 is a view similar to any of FIGS. 1 and 2, showing a second preferred embodiment of the present invention in which the heat insulating ring of FIG. 6 is employed, the figure being shown on an enlarged scale as compared with that of any of FIGS. 1 and 2.
Figure 8:
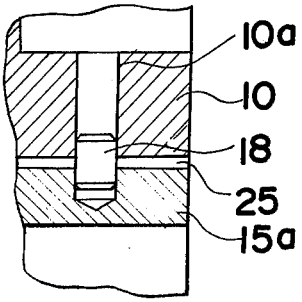
FIG. 8 is a view similar to FIG. 4, showing a manner of insertion of one of fixture pins employed in the support structure shown in FIG. 7.

Referring to FIGS. 6 to 8, there is illustrated an embodiment wherein the heat insulating member comprises a ring of a shape as shown in FIG. 6.

Referring first to FIG. 6, the ring 20 has one annular face 31 formed with at least two 180° spaced, substantially flattened projections 32 which outwardly protrude in a direction perpendicular to the plane of the annular face 31, that is, the plane of the remaining body of the ring 30. The other annular face of said ring 30 opposite to said annular face 31 is inwardly recessed to provide respective cavities 33 corresponding in position to said flattened projections 32.

For accommodating the heat insulating ring 30 of the construction shown in FIG. 6, the exhaust passage 13 within the engine casing 10 has an outer end portion radially outwardly indented in two stages to provide outer and inner bores 13*e* and 13*f*, the diameter of each of which is greater than that of the remaining portion of the exhaust passage 13, the diameter of said outer bore 13*e* being greater than that of the inner bore 13*f*.

The heat insulating ring 30, having an outer diameter slightly smaller than the diameter of the outer bore 13*e*, is inserted into the exhaust passage 13 with the annular face of said ring 30 opposite to the annular face 31 held in contact with an annular land which is formed at 10*c* by the difference in diameter between the outer and inner bores 13*e* and 13*f*.

The radially outwardly extending flange 15*a* of the tubular insert 15 has an outer diameter smaller than the outer diameter of the heat insulating ring 30 and is formed with a reduced diameter portion 15*d* at one of the opposed outer peripheray corners thereof which faces towards the annular land 10*c*. The reduced diameter portion 15*d* on the flange 15*a* of the tubular insert 15 is so sized as to fit into the inner bore of the heat insulating ring 30, leaving an adiabatic space 25 formed between the outer peripheral surface of the flange 15*a* and the surrounding wall defining the outer bore 13*e*, substantially as shown in FIG. 7. In an assembled condition as shown in FIG. 7, an annular face in the flange 15*a* which is defined by the difference in outer diameter between the flange 15*a* and the reduced diameter portion 15*d*, such as indicated at 15*e* merely contacts the flattened projections 32 at respective points 180° spaced from each other and, therefore, it will readily be seen that, even though the annular face of the ring 30 opposite to the annular face 31 wholly contacts the annular land 10*c*, transfer of heat energies from the tubular insert 15 to the engine casing 10 by way of the flange 15*a* can advantageously be minimized.

It is to be noted that, in practice, the particular construction of the heat insulating ring 30 shown in FIG. 6 allows the ring 30 to act like a flexible washer. Accordingly, prior to the exhaust tubing 19 (FIG. 2) being flanged to the engine casing 10, a portion of the flange 15*a* adjacent the opening of the exhaust port 12 may slightly outwardly project as clearly shown in FIG. 7 and, consequently, the bearing holes 10*a* in the engine casing 10 and the associated bearing recesses 15*c* in the flange 15*a* are respectively held out of alignment with each other.

However, insertion of the pins 18 can readily be achieved while an external axially pushing force is applied to the tubular insert 15 thereby allowing the ring 30 to deform, substantially as shown in FIG. 8.

It is to be noted that, although in the embodiment of FIG. 7 the heat insulating ring 30 has been described as formed with the projections 32 together with the corresponding cavities 33, they may not be always necessary and functional equivalents of these projections 32 may be formed on the annular face 15*e*. Moreover, the number of the projections 32 may be more than two.

Although the present invention has been fully described in conjunction with the preferred embodiments thereof with reference to the accompanying drawings, it should be noted that various changes and modifications are apparent to those skilled in the art. By way of example, in the embodiment of FIGS. 2 to 4, the adiabatic space 16 may not be always necessary and, therefore, if no space 16 is desired, the first bore 13*b* may have the same diameter as that of the second bore 13*c*. Moreover, the axially extending flange 22 may not always terminate in flush with the plane of the opening of the exhaust port 12 and may terminate halfway within the first bore 13*b* which may have a diameter equal to or different from the diameter of the second bore 13*c*.

In the embodiment shown in FIGS. 6 to 8, the inner bore 13*f* may not be always necessary.

Accordingly, these changes and modifications should be construed as included within the true scope of the present invention unless they depart therefrom.

What we claim is:

1. In a combustion engine comprising an engine casing, at least one combustion chamber formed in said engine casing, and at least one exhaust passage extending from said combustion chamber to an exhaust port formed in said engine casing for discharge of an exhaust gas, generated in said combustion chamber, by means of an exhaust manifold connected to said engine casing in alignment with said exhaust port, the improvement which comprises a substantially tubular insert having one end formed with a radially outwardly extending flange; said exhaust passage having one end adjacent said exhaust port radially outwardly indented to provide at least one bore and an annular land, said annular land being defined by the difference in diameter between said bore and the remaining portion of said exhaust passage; an annular heat insulating member adapted to be held in position between said annular land and said flange within said exhaust passage, the other end portion of said exhaust passage extending towards said combustion chamber with said radially outwardly extending flange situated within said bore; and a plurality of mounting pins inserted in substantially equally spaced relation to each other and each extending from said engine casing into said flange of said tubular insert to avoid any possible relative rotation of said insert with respect to said engine casing.

2. A combustion engine as claimed in claim 1, wherein the diameter of said bore is greater than the outer diameter of said flange of said insert, and further comprising an adiabatic space formed between the wall, which defines said bore, and the outer peripheral surface of said flange of the tubular insert.

3. A combustion engine as claimed in claim 2, wherein said heat insulating member comprises a ring having one annular face formed with a plurality of projections protruding in a direction perpendicular to the plane of said ring.

4. A combustion engine as claimed in claim 3, wherein said flange of the tubular insert is formed with an annular cut-out portion, said heat insulating ring, when held in position between said annular land and said flange of the tubular insert, having the other annular face engaged to said annular land with said projections accommodated in said annular cut-out portion.

5. A combustion engine as claimed in claim 2, wherein said heat insulating member comprises a ring having one annular face adjacent the outer periphery thereof formed with an axially outwardly extending flange which, when said ring is held in position within said exhaust passage, surrounds said flange of said tubular insert in spaced relation to the outer peripheral surface of said flange of said tubular insert.

* * * * *